US011866854B2

(12) United States Patent
Hurtz et al.

(10) Patent No.: US 11,866,854 B2
(45) Date of Patent: Jan. 9, 2024

(54) TEXTILE MACHINE HAVING A PLURALITY OF WORKSTATIONS AND A METHOD FOR MONITORING A TEXTILE MACHINE HAVING A PLURALITY OF WORKSTATIONS

(71) Applicant: Saurer Spinning Solutions GmbH & Co. KG, Übach-Palenberg (DE)

(72) Inventors: Bert Hurtz, Mönchengladbach (DE); Dirk Schiffers, Korschenbroich (DE); Ralf Siewert, Schwalmtal (DE); Tai Mac, Würselen (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 0 days.

(21) Appl. No.: 16/903,445

(22) Filed: Jun. 17, 2020

(65) Prior Publication Data

US 2020/0399794 A1 Dec. 24, 2020

(30) Foreign Application Priority Data

Jun. 19, 2019 (DE) ..... 102019116627.6

(51) Int. Cl.
*D01H 13/32* (2006.01)
*D01H 4/42* (2006.01)
*D01H 13/26* (2006.01)

(52) U.S. Cl.
CPC ..... *D01H 13/32* (2013.01); *D01H 4/42* (2013.01); *D01H 13/26* (2013.01)

(58) Field of Classification Search
CPC ..... D01H 13/20; D01H 13/22; D01H 13/24; D01H 13/145
See application file for complete search history.

(56) References Cited

U.S. PATENT DOCUMENTS 4,078,369 A * 3/1978 Brandis ..... D01H 13/16 57/265
4,570,430 A * 2/1986 Stahlecker ..... D01H 4/52 57/263

(Continued)

FOREIGN PATENT DOCUMENTS

CN 1214744 A 4/1999
CN 1228536 A 9/1999

(Continued)

OTHER PUBLICATIONS

Search Report from German Patent Application No. 102019116627.6, dated May 8, 2020, all enclosed pages cited.

(Continued)

*Primary Examiner* — Patrick J. Lynch
(74) *Attorney, Agent, or Firm* — Nelson Mullins Riley & Scarborough LLP

(57) ABSTRACT

Method for monitoring a textile machine having a plurality of workstations and a textile machine having a plurality of workstations, the textile machine having: a textile machine control unit, designed to capture different production figures of the individual workstations and to check whether the production figures exceed specified limit values; an input unit for inputting the limit values and selecting at least one production figure to be checked out of the set of production figures to be checked; and an indicating unit. The indicating unit has a plurality of signal units, which are arranged on the textile machine control unit and/or the workstations in question, are associated with the individual workstations and are designed in such a way that the result of the check of the at least one selected production figure to be checked for exceeding the allocated, specified limit value is indicated by different light signals.

11 Claims, 1 Drawing Sheet

(56) References Cited

U.S. PATENT DOCUMENTS

| | | | | | |
|---|---|---|---|---|---|
| 5,124,928 | A | | 6/1992 | Aemmer | |
| 5,385,008 | A | * | 1/1995 | Makino | D01H 13/1633 57/81 |
| 5,748,481 | A | * | 5/1998 | Nakade | B65H 63/06 57/264 |
| 6,062,074 | A | * | 5/2000 | Felix | D01H 13/22 73/160 |
| 6,244,030 | B1 | * | 6/2001 | Arb | B65H 63/065 57/264 |
| 2002/0103565 | A1 | * | 8/2002 | Hosel | D01G 31/00 700/130 |
| 2016/0168764 | A1 | * | 6/2016 | Bungter | B65H 63/00 362/89 |
| 2021/0148012 | A1 | * | 5/2021 | Archontopoulos | D01H 13/22 |
| 2021/0225158 | A1 | * | 7/2021 | Umemoto | G08B 5/36 |

FOREIGN PATENT DOCUMENTS

| | | | | | |
|---|---|---|---|---|---|
| CN | 101676454 | A | | 3/2010 | |
| DE | 4335459 | A1 | | 4/1995 | |
| DE | 19930714 | A1 | | 1/2001 | |
| DE | 102007040184 | A1 | | 2/2009 | |
| DE | 102008003704 | A1 | | 7/2009 | |
| DE | 102014018628 | A1 | | 6/2016 | |
| DE | 102015118762 | A1 | | 5/2017 | |
| EP | 0365901 | A2 | | 5/1990 | |
| EP | 2573236 | A2 | * | 3/2013 | B65H 63/00 |
| EP | 2166137 | B1 | * | 12/2015 | B65H 63/00 |
| EP | 3006929 | A1 | | 4/2016 | |
| EP | 3009388 | A2 | | 4/2016 | |
| EP | 3293295 | A1 | * | 3/2018 | D01H 13/14 |
| JP | S6056775 | A | | 4/1985 | |
| JP | 01229826 | A | * | 9/1989 | D01H 1/244 |
| WO | WO-2017072683 | A1 | * | 5/2017 | B65H 63/00 |
| WO | 2018/096427 | A2 | | 5/2018 | |

OTHER PUBLICATIONS

Office Action from Bangladeshi Patent Application No. 184/2020/1613, dated Mar. 4, 2021, 1 page cited and enclosed.

Office Action from Chinese Patent Application No. 202010558513.X, dated Jan. 5, 2022, all enclosed pages cited.

Office Action from Chinese Patent Application No. 202010558513.X, dated Jul. 14, 2022, all enclosed pages cited.

Extended European Search Report for European Patent Application No. 20180135.4, dated Nov. 18, 2020, all enclosed pages cited.

Office Action from Indian Patent Application No. 202024025376, dated Jun. 18, 2021, all enclosed pages cited.

* cited by examiner

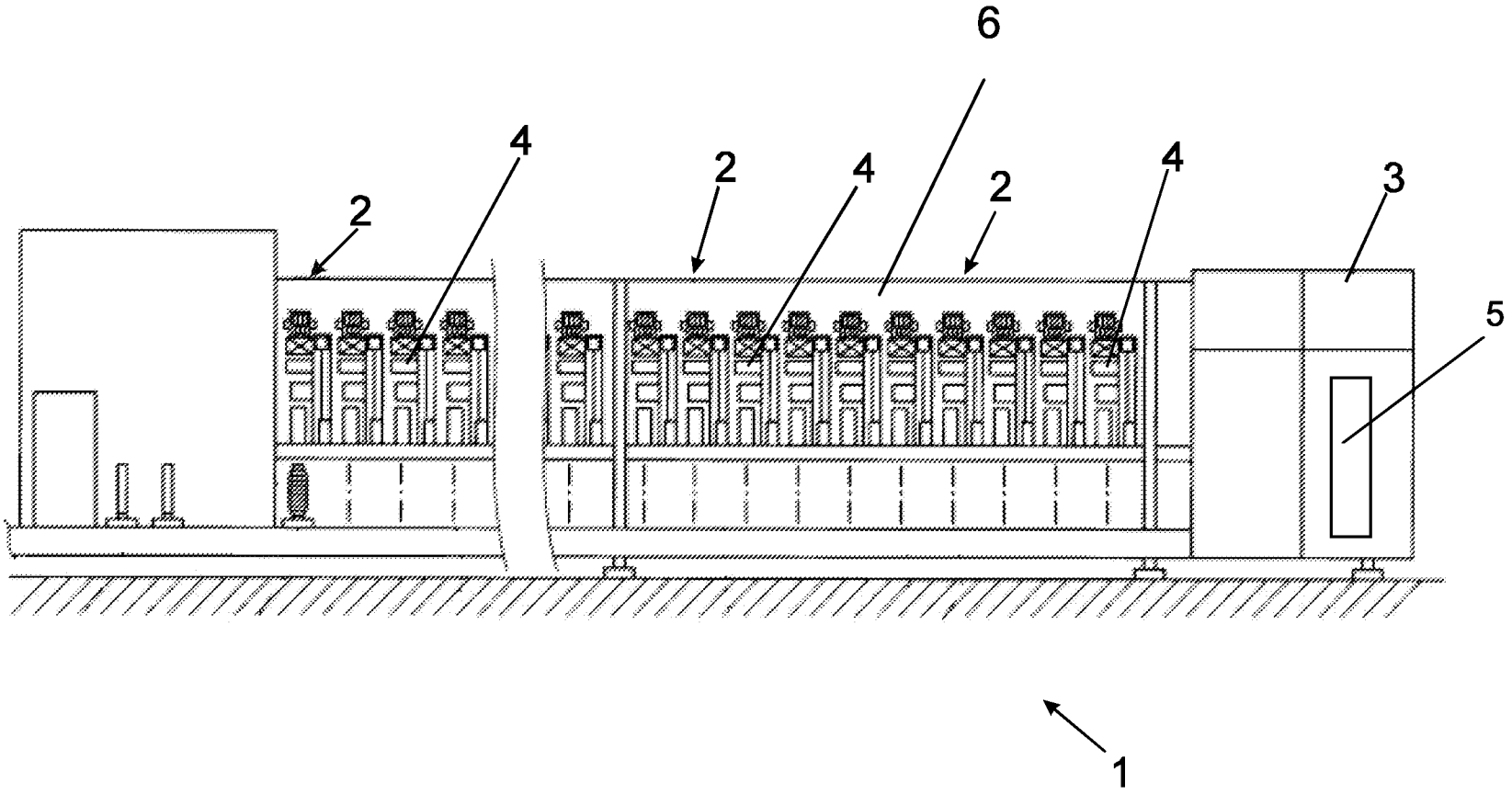
5
3
4
6
2
4
2
4
2
1

TEXTILE MACHINE HAVING A PLURALITY OF WORKSTATIONS AND A METHOD FOR MONITORING A TEXTILE MACHINE HAVING A PLURALITY OF WORKSTATIONS

CROSS-REFERENCE TO RELATED APPLICATION

This application claims priority from German National Patent Application No. DE 10 2019 116 627.6, filed Jun. 19, 2019, entitled "Textilmaschine mit mehreren Arbeitsstellen sowie Verfahren zur Überwachung einer Textilmaschine mit mehreren Arbeitsstellen", the entire contents of which are incorporated herein by reference.

FIELD OF THE INVENTION

The present invention relates to a textile machine having a plurality of workstations, more particularly spinning positions, having: a textile machine control unit, which is designed to capture different production figures of the individual workstations and to check whether the production figures exceed specified limit values, an input unit for inputting the limit values and selecting the production figures to be checked and an indicating unit, which is connected to the textile machine control unit in order to optically output the result of the check, and a method for monitoring a textile machine having a plurality of workstations, more particularly spinning positions, in which method different production figures of the individual workstations are captured, it is checked whether the selectable production figures exceed specified limit values and subsequently the result of the check is optically indicated via an indicating unit by means of a textile machine control unit.

BACKGROUND OF THE INVENTION

Continuous monitoring and evaluation of the production figures of the individual workstations, e.g. spinning positions, of a textile machine are required for productive operation of the textile machine. The examination of the production figures determined by means of suitable sensors, such as piecing reliability, number of thread breaks, number of clearer cuts, efficiency or the like, over a definable time period comprising the current operation allows the machine operator to detect problematic workstations early so that appropriate countermeasures can be taken, which are carried out e.g. by what are referred to as service units, which can be moved on the textile machine along the workstations and independently perform maintenance processes on the workstations.

European Patent Publication EP 0 365 901 discloses that specific production figures are continually captured over a moving interval and are statistically evaluated, in which case continually updated mean values are available for evaluating the production. These mean values can be checked with respect to the deviations thereof from reference values. If the deviations exceed specified limit values, this is signaled so that appropriate maintenance work can be performed.

It is essential for this purpose that the problematic workstation is clearly indicated so that this workstation can be quickly identified and countermeasures can be taken immediately. Known indications on displays of central control units require a machine operator to constantly monitor the indications in order to detect any signaling. In the absence of the machine operator, any signaling indicated by the control unit remains undetected until the machine operator returns, and this can lead to longer production downtimes at the workstations in question.

SUMMARY OF THE INVENTION

Proceeding from here, the problem addressed by the present invention is that of providing a method for monitoring a textile machine having a plurality of workstations and a textile machine having a plurality of workstations, said method and said textile machine enabling quick detection and identification of workstations whose production figures exceed specified limit values.

The present invention solves the problem by means of a textile machine having a plurality of workstations, more particularly spinning positions, the textile machine comprising: a textile machine control unit, which is designed to capture different production figures of the individual workstations and to check whether the production figures exceed specified limit values, an input unit for inputting the limit values and selecting at least one production figure to be checked from the set of production figures to be checked, and an indicating unit which is connected to the textile machine control unit for the optical output of the result of the check of the at least one selected production figure to be checked for exceeding the assigned predetermined limit value, characterised in that the indicating unit has a plurality of signal units, which are arranged on the textile machine control unit and/or the workstations in question, are associated with the individual workstations and are designed in such a way that the result of the check of the at least one selected production figure to be checked for exceeding the allocated, specified limit value is indicated by means of different light signals.

The present invention solves the problem by means of a method for monitoring a textile machine having one workstation or a plurality of workstations, more particularly spinning positions, in which method different production figures of the individual workstations are captured, at least one selectable production figure is checked for exceeding an assigned, specified limit value and subsequently the result of the check is optically indicated via an indicating unit, characterised in that the indicating unit comprises a plurality of signal units, which are associated with the individual workstations and are arranged on the textile machine control unit and/or the workstation and at which the result of the check of the at least one selected production figure to be checked for exceeding the allocated, specified limit value is indicated by means of different light signals.

Advantageous further developments of the textile machine are set forth herein, and an advantageous further development of the method are set forth herein.

The textile machine according to the present invention is characterised in that the indicating unit has a plurality of signal units, which are arranged on the textile machine control unit and/or the workstations in question, are associated with the individual workstations and are designed in such a way that the result of the check of the at least one selected production figure to be checked for exceeding the allocated, specified limit value is indicated by means of different light signals.

For the purposes of the present invention, a production figure is a value which results from a predeterminable or predetermined combination of at least two or more defined values, in particular values which differ from one another.

According to a preferred variant of the present invention, a signal unit is arranged on each workstation, which signal unit indicates the result of the check directly at the workstation. The signal unit is arranged in an area that is highly visible to the machine operator, in such a way that the signal unit can be clearly recognised even from a distance, so that faulty workstations, i.e. workstations whose production figures exceed specified limit values, can be identified from a distance even if the machine operator does not have a display of the indicating unit in view. Required maintenance work can therefore be recognised and initiated.

Because workstations needing maintenance are well detected, necessary maintenance work can be triggered quickly so that sufficiently high productivity can be ensured for the workstation requiring maintenance. Thus, high productivity of the textile machine can be maintained overall since workstations running poorly or functioning improperly can be quickly adjusted.

The textile machine according to the present invention also makes it possible to signal with sufficient pre-warning time that a can containing a fibre band for a spinning machine, from which can a fibre band is continuously supplied to a spinning machine, is running out. An appropriate measure, such as requesting and providing a new can, can be initiated in good time manually by a machine operator or in automated manner. The exchange of a can should preferably be acknowledged so that it is possible to subsequently monitor the running out of the can, for example by means of the measurable production of the workstation. Production figures of the can that are to be monitored can be, for example, the length of the fibre band of the can in metres, the weight of the fibre band or the diameter of the take-up package, which particularly reliably enable timely signalling of a required replacement of the can.

The signal units arranged on the workstations also enable the indication and identification of workstations at which corresponding product groups, e.g. identical yarns, are being processed and workstations that are not assigned to any product groups.

The signal units can in principle be designed to signal the results of the check of the monitoring results in any way. However, according to an advantageous embodiment of the present invention the signal unit is designed to indicate the result of the check by means of light signals of different brightness and/or colour.

In the case that the results are indicated by light signals of different brightness, there is provision, for example, for workstations operating within the range of the defined production figures to be indicated by signal units which are switched off or lit up with low intensity, whereas problematic workstations are indicated by signal units lit up with high intensity. This embodiment of the present invention allows problematic workstations to be quickly identified by a machine operator in a particularly advantageous way. Necessary maintenance work can thus be quickly initiated by the machine operator.

Alternatively or in addition to the indication of the productivity of the workstations by means of signal units of different brightness, the signal units can also be designed to indicate the results of the check by colour. This embodiment allows a machine operator to immediately detect workstations needing maintenance in a particularly advantageous way. For example, workstations operating within the specified range can be indicated by a signal unit displaying a green light signal. Workstations needing maintenance or operating incorrectly can be indicated by a different colour, e.g. red. This contrast of the signal units makes it easier for a machine operator to detect, particularly from a distance, workstations whose production figures lie outside of the specified limit values.

Alternatively or in addition to the indication of the productivity of the workstations by means of signal units of different brightness and/or colour, a further development of the present invention provides that the signal units are designed to indicate the result of the check by means of continuous light and flashing light. This embodiment of the present invention improves the detectability of workstations needing maintenance from a distance in a supplementary way. The frequency of the flashing light can be matched to the need for maintenance. Workstations on which maintenance should be performed with high priority can be indicated by a signal light flashing at a high frequency, while workstations on which maintenance should be performed with low priority are indicated by a flashing light having a low frequency. The need of the individual workstations for maintenance is thus indicated to a machine operator in a particularly advantageous way.

The signal units are arranged on the workstations in such a way that the signal units can be comfortably recognised by a maintenance worker even from a distance. According to a particularly advantageous embodiment of the present invention, the signal units are arranged on the workstations in such a way and the light signals are produced at the signal units in such a way that the signal units can be used for automatic identification and/or alignment of a service unit relative to the workstations, the service unit comprising an optical sensing device.

According to this embodiment of the present invention, the signal unit allows a service unit to automatically detect workstations needing maintenance. The signal units are additionally or alternatively designed in such a way that the service unit, which performs maintenance work in an automated manner, aligns itself relative to the workstation by means of the signal units. The signal unit, e.g. a lighting strip, has special, e.g. brighter, signal points for this purpose, which enable the service unit to optimally align itself relative to the workstation. Thus, additional alignment elements for positioning the service units relative to the workstation are not required.

In principle, the design of the signal units can be freely chosen. According to a further development of the present invention, the signal units comprise an LED indicator. The use of LED indicators is characterised in that they are easy to recognise from a distance. Furthermore, LED indicators are particularly low-maintenance and energy-efficient.

The method according to the present invention is characterised in that the indicating unit comprises a plurality of signal units associated with the individual workstations, the signal units being arranged on the textile machine control unit and/or the workstation and the result of the check being indicated at the signal units by means of different light signals. According to the present invention, a signal unit is arranged at each workstation and/or the textile machine control unit, which signal unit indicates the result of the check directly for each workstation. The signal unit is arranged in an area that is highly visible to the machine operator, in such a way that the machine operator can clearly recognise, even from a distance, when individual workstations have a need for maintenance. If the signal unit is arranged at the workstations, faulty workstations, i.e. workstations whose production figures exceed specified limit values, can be identified particularly easily even from a distance and required maintenance work can be initiated.

Because workstations needing maintenance are well detected, necessary maintenance work can be triggered quickly so that high productivity can be ensured for the workstation requiring maintenance. Thus, high productivity of the textile machine can be maintained overall since workstations running poorly or functioning improperly can be quickly adjusted.

By means of the method according to the present invention, it is also possible to indicate in good time that a can will soon run out so that the organising or providing of a new, full can be initiated in good time. The time window for the pre-warning at the signal unit can be set by a machine operator at the textile machine control unit. After the can has been exchanged, this is acknowledged so that the corresponding counter can be restarted. It is possible to monitor the running out of the can by means of the measurable production of the workstation, determined in metres or kilograms, or by means of the diameter of the take-off package, for example. For the monitoring of the can it can be provided, for example, that the signal unit lights up continuously when there is sufficient can content and switches to flashing when a defined limit value is reached.

In principle, the results of the check can be optically output by means of the signal unit in any way, for example by continuous light and flashing light with different flashing frequencies. According to an advantageous further development of the present invention, the result of the check is indicated by means of light signals of different brightness and/or colour. Indication by colour is characterised in that it is particularly easy for a machine operator to recognise. For example, problematic workstations can be indicated by a red light and workstations operating properly can be indicated by a green light, this being particularly easy for the machine operator to recognise even from a distance. Particularly serious malfunctions can be indicated additionally by a red flashing light.

According to a further development of the present invention, it is also provided that workstations having identical product groups are indicated by means of the light signals. If the use of coloured light signals is advantageously provided, the workstations that are processing identical product groups can be indicated by light signals of matching colour. This also allows workstations that are not assigned to any product group to be quickly identified.

In principle, the production figures determined at the workstations can be processed and compared with specifiable reference values in any way. However, according to an additional embodiment of the present invention the production figures to be checked are determined from a mean value of at least two or a plurality of individual production figures determined over a selectable time period, in particular at selectable intervals or selectable times. The mean value of individual production figures, e.g. the number of clearer cuts or thread breaks or the efficiency, i.e. what percentage of the possible machine running time is achieved, or the piecing reliability, i.e. the ratio of the number of successful piecings to the number of piecing attempts, is constantly updated over a defined period of time. If the mean value exceeds a definable limit value, this is indicated at the signal unit. The mean value is preferably determined from the arithmetic, geometric or harmonic mean value or from a combination of at least two of these mean values. This embodiment of the present invention thus enables early detection of a worsening production process at the workstations.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

An embodiment example of the present invention is explained below with reference to a figure. In the drawing:

FIG. 1 is a schematic illustration of a spinning machine having a plurality of spinning positions, in a side view.

DESCRIPTION OF THE PREFERRED EMBODIMENTS

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

FIG. 1 shows a schematic illustration of an embodiment of a textile machine, which is in the form of a spinning machine 1 and has a plurality of adjacently arranged spinning positions 2, which form the individual workstations of the textile machine. The spinning positions 2 are controlled and monitored by means of a central textile machine control unit 3. An input unit device 5 for inputting of process parameters and calling up of production figures on the textile machine control unit 3 allows a machine operator, inter alia, to input process parameters and call up production figures. In order to signal spinning positions 2 needing maintenance, an indicator 6 having a signal unit 4 connected to the textile machine control unit 3 is arranged at each spinning position 2, which signal unit 4 indicates the operating state of the spinning position 2 by means of a coloured light signal. Spinning positions 2 operating within defined limit values are indicated by a green light signal. Spinning positions 2 requiring maintenance are indicated by a continuous red light. The signal units 4 are arranged in such a way that spinning positions 2 needing maintenance can be easily detected by a machine operator from a distance and also can be detected by an automatically operating service unit (not shown here), which can be moved along the spinning positions 2.

A spinning position 2 needing maintenance is indicated in accordance with the settings set at the textile machine control unit 3. After one or more production figures have been selected from a specified set, e.g. the efficiency, an observation time period is defined.

For the purposes of the present invention, the efficiency preferably corresponds to a ratio of the actual production time, which is a time in which production actually took place, to a target production time, which is a time in which production could take place. In the present preferred embodiment example, "production actually took place" further preferably means that the corresponding spinning position 2 has spun yarn, whereas "production could take place" describes a state in which the spinning position is in a state ready for production but no yarn is spun. The latter may be the case, for example, if the spinning position is in a waiting state in which spinning position 2 is waiting for something such as the feeding of a new spinning can, the doffing of a finished take-up package, or the removal of a blockage by the operator or similar. To calculate the efficiency, it is further preferable to define a common point in time as a reference point for both the actual and target production time, for example the start of the observation period as well as the start of a shift. If, simply as an example, a spinning position 2 has been in a state ready for production for 60 minutes since the start of the shift, but has produced for only 53 minutes since the start of the shift, the efficiency of the spinning position 2 for the period under consideration is approximately 88.3%.

According to a further preferred embodiment example, a definable production group consisting of a predefinable number of spinning positions 2 or even the spinning machine comprising all the spinning positions 2 can be considered with regard to a selected production figure such as the efficiency. In this preferred embodiment example, a distinction is made between a mean efficiency and a current efficiency. The mean efficiency of a number of spinning positions 2 combined to form a production group (which can also be the spinning machine) is preferably the sum of the actual production times of these spinning positions 2 divided by a sum of the target production times of these spinning positions 2. In contrast, a current efficiency defines an instantaneous value which, in relation to this number of spinning positions 2, indicates how many spinning positions 2 are currently producing or spinning a yarn. For example, the production group can comprise 600 spinning positions 2, of which 578 spinning positions 2 are currently producing or spinning a yarn. This results in a current efficiency of approximately 96.3%. The mean efficiency is particularly suitable for evaluating and assessing a production quality, while the current efficiency can be used to analyse a trend and to detect possible problems at an early stage.

According to an alternative preferred embodiment example, the produced quantity, length, weight or another suitable parameter can be used as a basis for calculation instead of the time. In particular, relying on the quantity, length or weight proves to be advantageous if there is no linear relationship between a production time and a production quantity.

In the preferred embodiment example, the textile machine control unit 3 captures the efficiencies of all the spinning positions 2 at predefined intervals after the observation period has been defined, e.g. every 2 minutes, and stores these efficiencies in a memory of the textile machine control unit 3. After the defined observation time period of e.g. 4 hours has passed, there are 120 measurements. The textile machine control unit 3 then determines the mean value of the efficiency over the observation time period for the first time. From then on, the mean value over the last 4 hours is determined with each new measured value, i.e. every 2 minutes. That is, the mean value is continually updated so that the efficiency for each spinning position 2 over the last 4 hours is always available.

If the mean efficiency of a spinning position 2 falls below a previously defined lower limit value, this spinning position 2 is indicated as needing maintenance by means of a corresponding light signal at the signal unit 4. This spinning position 2 can be quickly identified by a machine operator from a distance so that appropriate countermeasures can be immediately initiated. After the malfunction has been corrected, the mean efficiency rises again and, after it has exceeded the defined lower limit value, this spinning position 2 is again indicated as operating properly by the textile machine control unit 3. Alternatively or in addition to the capturing of the efficiency, other production figures can also be used for monitoring. These can be, for example, the number of clearer cuts or thread breaks or the piecing reliability.

LIST OF REFERENCE SIGNS

1 Textile machine/spinning machine
2 Workstation/spinning position
3 Textile machine control unit
4 Signal unit It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A method for monitoring a textile machine having one workstation or a plurality of workstations in which method different production figures of the individual workstations are captured, at least one selectable production figure is checked for exceeding a specified limit value and subsequently a result of the check is optically indicated, characterised in that a plurality of lighting strips are associated with the individual workstations and are arranged on a textile machine control unit and/or the one workstation or the plurality of workstations and at which the result of the check of the at least one selected production figure to be checked for exceeding the specified limit value is indicated by different light signals, wherein the textile machine has a service unit capable of being moved along the workstations, for automatically detecting workstations in need of maintenance and automatically performing maintenance work, wherein the lighting strips are arranged at the workstations in such a way and that the light signals are produced at said lighting strips in such a way that an optical detection device of the service unit automatically detects workstations in need of maintenance and/or alignment relative to the workstation by using said light signals, and characterised in that the textile machine has a plurality of spinning positions, and characterised in that the textile machine control unit captures efficiencies of the plurality of spinning positions at predefined intervals after a defined observation period.

2. The method according to claim 1, characterised in that the lighting strips are designed to indicate the result of the check by light signals of different brightness and/or colour.

3. The method according to claim 1, characterised in that the lighting strips are designed to indicate the result of the check by continuous light and flashing light.

4. The method according to claim 1, characterised in that the lighting strips have an LED indicator.

5. The method according to claim 1, characterised in that workstations having identical product groups are indicated by the light signals.

6. The method according to claim 1, characterised in that the production figures to be checked are determined from a mean value of a plurality of production figures determined at selectable intervals over a selectable time period, the mean value being an arithmetic, geometric or harmonic mean value or a mean value combined from at least two of the arithmetic, geometric or harmonic mean values.

7. The method according to claim 1, characterised in that at least one of the efficiencies is a mean efficiency.

8. The method according to claim 7, characterised in that the mean efficiency is used to evaluate and assess a production quality.

9. The method according to claim 7, characterised in that when the mean efficiency of a spinning position falls below a previously defined lower limit value, the spinning position is indicated as needing maintenance by a corresponding light signal at the lighting strip.

10. The method according to claim 1, characterised in that at least one of the efficiencies is a current efficiency.

11. The method according to claim 10, characterised in that the current efficiency is used to analyze a trend.

* * * * *